US007788875B2

(12) United States Patent
Wendt

(10) Patent No.: US 7,788,875 B2
(45) Date of Patent: Sep. 7, 2010

(54) TRIM SYSTEM CLIP FOR ISLAND CEILING

(75) Inventor: Alan C. Wendt, Inverness, IL (US)

(73) Assignee: USG Interiors, Inc., Chicago, IL (US)

( * ) Notice: Subject to any disclaimer, the term of this patent is extended or adjusted under 35 U.S.C. 154(b) by 1303 days.

(21) Appl. No.: 11/283,918

(22) Filed: Nov. 21, 2005

(65) Prior Publication Data

US 2007/0113513 A1 May 24, 2007

(51) Int. Cl.
*E04B 9/10* (2006.01)
*E04B 9/12* (2006.01)
*E04B 1/38* (2006.01)

(52) U.S. Cl. ..... 52/712; 52/506.06; 52/506.07; 52/718.04

(58) Field of Classification Search ..... 52/506.06, 52/506.07, 712, 716.7, 587.1, 288.1, 290, 52/717.06, 718.01, 718.04, 718.06, 506.08; 248/342, 343, 300; 24/295; 403/326, 329
See application file for complete search history.

(56) References Cited

U.S. PATENT DOCUMENTS

| | | | | | |
|---|---|---|---|---|---|
| 972,102 | A | * | 10/1910 | Eichmann | 52/784.12 |
| 1,263,323 | A | * | 4/1918 | Kaempf | 248/513 |
| 1,431,662 | A | * | 10/1922 | Horning | 248/300 |
| 1,491,571 | A | * | 4/1924 | Tomkinson et al. | 52/708 |
| 2,061,263 | A | * | 11/1936 | Wells | 52/211 |
| 2,205,700 | A | * | 6/1940 | Smith | 52/288.1 |
| 2,225,329 | A | * | 12/1940 | Barnes | 312/126 |
| 2,233,725 | A | * | 3/1941 | Begin et al. | 211/119.1 |
| 2,245,785 | A | * | 6/1941 | Jentzer, Jr. | 52/416 |
| 2,311,410 | A | * | 2/1943 | Meyer | 52/716.6 |
| 2,321,671 | A | * | 6/1943 | La Grotta | 52/242 |
| 2,454,550 | A | * | 11/1948 | Burns | 248/264 |
| 2,560,765 | A | * | 7/1951 | Haynam | 248/264 |
| 2,586,327 | A | | 2/1952 | Haertel | |
| 2,663,390 | A | * | 12/1953 | Dordel | 52/204.53 |
| 2,792,999 | A | * | 5/1957 | Lorentzen | 248/264 |
| 2,866,233 | A | * | 12/1958 | Lydard | 403/387 |
| 3,001,246 | A | * | 9/1961 | Mather | 312/236 |
| 3,208,119 | A | * | 9/1965 | Seckerson | 52/716.6 |
| 3,388,521 | A | * | 6/1968 | Rocco et al. | 52/506.06 |
| 3,418,780 | A | * | 12/1968 | Dalton et al. | 312/236 |
| 3,444,658 | A | * | 5/1969 | Gobel | 52/94 |
| 3,507,470 | A | * | 4/1970 | Gobel | 248/205.1 |
| 3,602,473 | A | * | 8/1971 | Van Riet et al. | 248/317 |
| 3,685,238 | A | * | 8/1972 | Fisher et al. | 52/506.07 |
| 3,862,535 | A | * | 1/1975 | Byssing | 52/714 |
| 3,998,419 | A | * | 12/1976 | Semmerling | 248/323 |

(Continued)

FOREIGN PATENT DOCUMENTS

EP 481905 A1 * 4/1992

(Continued)

*Primary Examiner*—Robert J Canfield
(74) *Attorney, Agent, or Firm*—Pearne & Gordon LLP

(57) ABSTRACT

An edge trim system for suspended island ceilings in which a one-piece clip couples standard grid tees to standard wall molding. The clip is arranged to snap onto the grid tees where the ceiling boundary is along a line of the grid and to be screw fastened onto a tee where the ceiling boundary is other than along the grid. The clip is arranged to snap into and retain the molding in place without fasteners.

5 Claims, 4 Drawing Sheets

U.S. PATENT DOCUMENTS 4,019,300 A * 4/1977 Sauer et al. ..... 52/665
4,497,150 A * 2/1985 Wendt et al. ..... 52/242
4,513,549 A * 4/1985 Wendt ..... 52/211
4,513,557 A * 4/1985 Wendt ..... 52/489.1
4,606,170 A * 8/1986 Mendenhall ..... 108/27
4,696,141 A * 9/1987 Nassof ..... 52/506.07
4,744,188 A * 5/1988 Ahren ..... 52/506.07
5,024,034 A * 6/1991 Gailey ..... 52/506.07
5,152,117 A * 10/1992 Wynar ..... 52/712
5,195,289 A * 3/1993 LaLonde et al. ..... 52/506.06
5,201,787 A * 4/1993 LaLonde et al. ..... 52/506.06
5,609,007 A * 3/1997 Eichner ..... 52/747.1
5,624,202 A * 4/1997 Grierson ..... 403/327
5,822,941 A * 10/1998 Kinsella ..... 52/506.05
5,927,037 A * 7/1999 Kinsella ..... 52/506.05
5,937,605 A * 8/1999 Wendt ..... 52/506.06
6,216,408 B1 * 4/2001 Davidson ..... 52/300
6,298,623 B1 * 10/2001 Wendt ..... 52/506.06
6,322,029 B1 * 11/2001 Sonnenberg et al. ... 248/222.13
6,763,641 B1 * 7/2004 Ahren et al. ..... 52/506.06
6,877,284 B2 * 4/2005 Thompson ..... 52/112
7,017,317 B2 * 3/2006 Capozzo ..... 52/506.07
7,062,886 B2 * 6/2006 Auriemma ..... 52/506.07
7,143,562 B2 * 12/2006 Krantz-Lilienthal et al. ..... 52/506.06
7,284,736 B2 * 10/2007 Franssen ..... 248/251
2003/0093969 A1 * 5/2003 Saldana ..... 52/715
2003/0155474 A1 * 8/2003 Dean et al. ..... 248/300
2004/0113034 A1 * 6/2004 Chen et al. ..... 248/300
2008/0086962 A1 * 4/2008 Jahn et al. ..... 52/220.6

FOREIGN PATENT DOCUMENTS

GB 2132073 A * 7/1984
GB 2266736 A * 11/1993

* cited by examiner

TRIM SYSTEM CLIP FOR ISLAND CEILING

The invention relates to suspended ceiling systems and, more particularly, to a trim system for island ceilings.

PRIOR ART

Architects and interior designers have applications where suspended island ceilings are desirable or mandated. A variety of edge trim systems have been developed to serve this need, but due to their specialized nature they can be expensive and may not be readily available from stock inventory at a local, regional or even national distribution center. Accordingly, there exists a need for an edge trim system that is readily available and that, preferably, is relatively economical to supply and easy and quick to install.

U.S. Pat. Nos. 4,744,188, 5,195,289, 5,937,605, and 6,298,623 show examples of trim systems for island ceilings.

SUMMARY OF THE INVENTION

The invention provides a clip capable of joining standard grid tees and readily available wall molding components to form a finished edge for a suspended island ceiling. The clip, while preferably being a simple, single piece, sheet metal stamping, affords a high degree of versatility. The clip is capable of mounting the molding on the free edge of a ceiling at right angles to the grid pattern, or at substantially any other desired angle.

The disclosed clip is easy and quick to install because, when the trim is to be mounted on parallel grid tees, it can be simply snapped onto the grid tees and, in all cases, the molding can be snapped onto the clip for an installation. The assembly of a molding on the clips is accomplished without the use of separate fasteners so that the smooth appearance of the molding is retained. Because of its simplicity, the clip can be economically produced with limited tooling investment and negligible waste.

The clip, while small in size, is large in contribution. The clip is the key to the combined practical use of standard grid tees and standard wall molding components. The clip, being relatively inexpensive, small in size, and light in weight, can be stocked for sale at local, regional, or national distribution centers dealing in conventional ceiling products, since the cost of warehousing and/or shipping it is comparatively low. The ready availability of the clip product gives architects, designers and contractors an easy and fast solution to island ceiling design requirements.

DESCRIPTION OF THE PREFERRED EMBODIMENT

Figure 1:
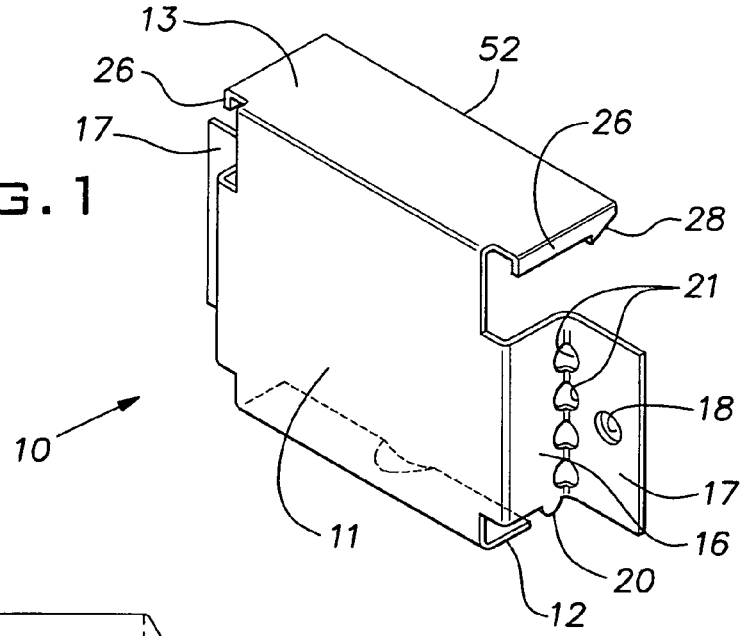
FIG. 1 is a perspective view of a clip constructed in accordance with the present invention.
Figure 2:
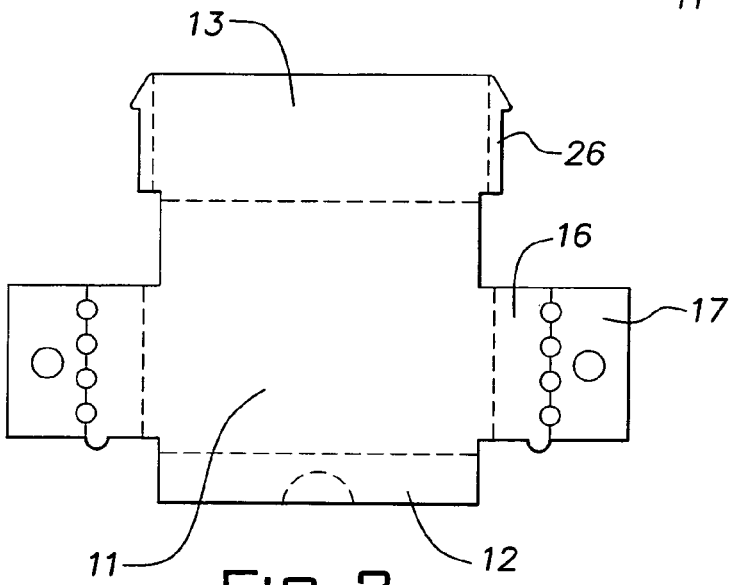
FIG. 2 is a blank form drawing of the clip as it is stamped from sheet stock.
Figure 3:
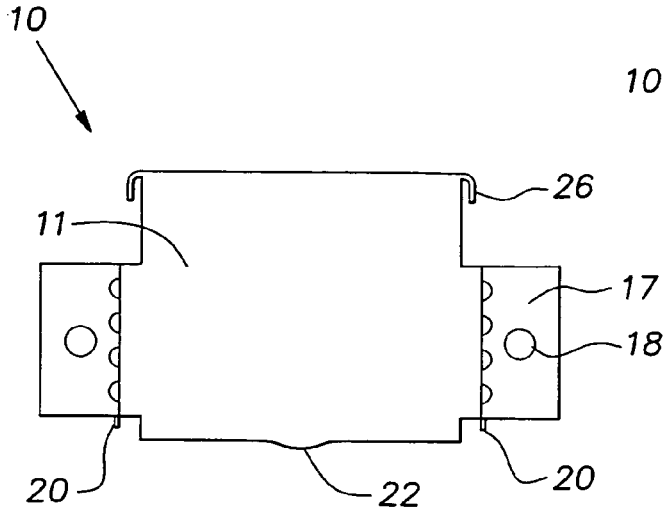
FIG. 3 is a front elevational view of the clip.
Figure 4:
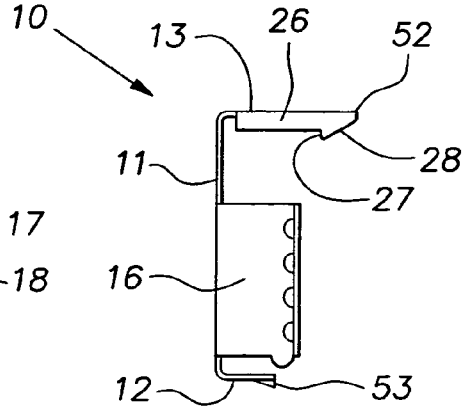
FIG. 4 is a side elevational view of the clip.

Referring now to the figures, a clip or bracket 10 is preferably formed of sheet metal, for example, 0.020-0.024" thickness sheet steel. The various structural elements of the clip 10 preferably comprise single ply segments of a common piece of sheet metal. FIG. 2 shows the original preform of the clip as it is stamped from metal sheet stock. Broken lines in FIG. 2 represent bend lines on which the stamped preform is bent to produce the three-dimensional low profile shape of the clip 10. When formed into its finished shape and oriented for use, the clip 10 has a generally planar vertical center section 11 and lower and upper generally horizontal extensions 12 and 13 projecting from the center section. Along vertical sides of the center section 11, the clip 10 is formed with standoffs or legs 16 perpendicular to the plane of the center section. The distal ends of the legs are formed with feet or tabs 17 extending laterally outwardly in opposite directions. The feet 17 are in a common plane spaced a predetermined distance from the plane of the center section 11. The feet have holes 18 for locating mounting screws 19 (FIGS. 5, 6, 8 and 9). Perforations in the form of round holes 21 are made along the bend lines between the legs 16 and feet 17. Each leg 16 includes a depending locating tab element 20 adjacent the bend line or corner between the respective leg and foot 17.

The lower extension 12 is generally perpendicular to the center section 11. At its center, the extension 12 is formed with a thumbnail shaped grip or catch 22 projecting downwardly from the plane of the remainder of the extension. The lower extension 12 projects from the center section 11 a distance less than the spacing between the plane of the center section and the plane of the feet 17.

The upper extension 13 is generally perpendicular to the center section 11 and projects from the center section a distance somewhat greater than the distance between the plane of the center section and the plane of the feet 17. Lateral extremities of the upper extension 13 have downturned flanges 26. Distal from the center section, these flanges 26 include a rearwardly facing hook or catch edge surface 27 spaced from the plane of the feet 17 a predetermined distance. Outward of the hook edge surface 27, with reference to the center section 11, the flanges 26 are formed with upwardly angled cam edge surfaces 28.

Figure 5:
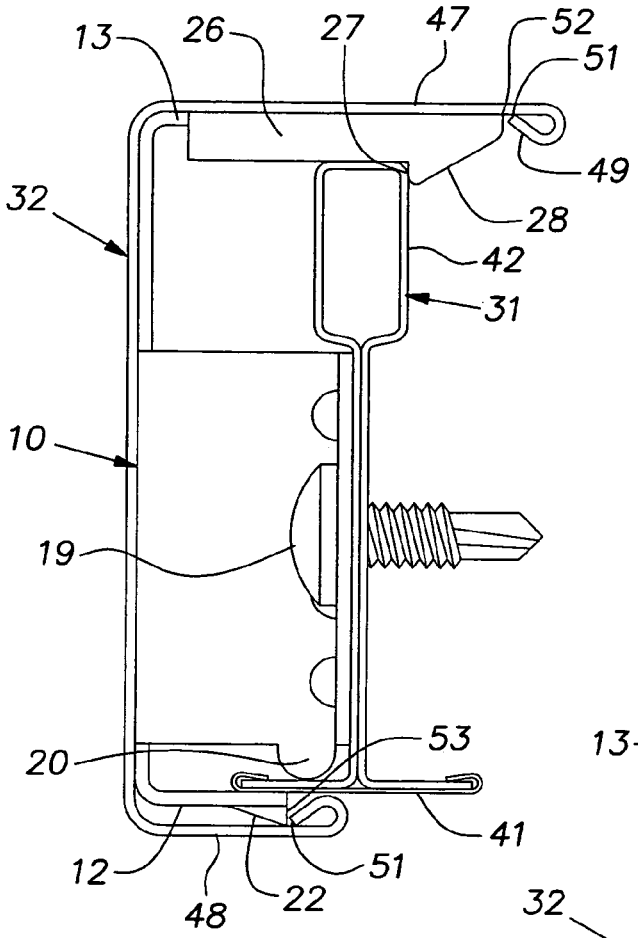
FIG. 5 is a side elevational view of the clip and molding installed on a narrow face grid tee.
Figure 6:
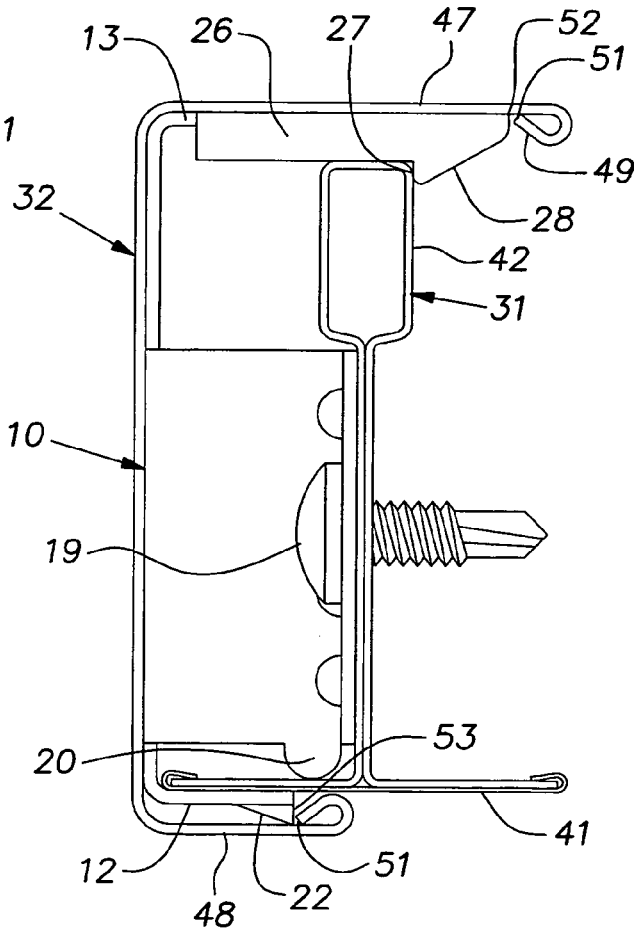
FIG. 6 is a side elevational view of the clip and molding installed on a regular face grid tee.

The clip 10 is constructed and arranged so that in its simplest mode of use, it is assembled on a grid tee 31 with a snap-on action and is coupled with an edge molding 32 by a snap-in action. More particularly, where an island ceiling has main or cross grid tees 31 running along at its borders or margins such as at the sides, designated 36-37, of the partial island ceiling 35 illustrated in FIG. 7, clips 10 can be simply and quickly snapped onto the grid tees at spaced locations. FIGS. 5 and 6 show the relationship of a clip 10 with a narrow face grid tee 31 and with a standard width grid tee 31, respectively. The nominal standard height of the tee 31 is 1-½". The clip 10 is installed on a tee 31 by tilting the clip so that the lower extension 12 contacts the lower face of the tee before the upper extension 13 contacts the tee. With the positioning tabs 20 located above the flange, designated 41 of the tee 31, the clip 10 is pivoted from its tilted position to an upright position. During this movement, the cam surfaces 28 on the upper extension flanges 26, cause the clip 10 to resiliently flex and enable the catch surfaces 27 to pass over the upper reinforcing bulb, designated 42, of the tee 31. When the catch or hook edge surfaces 27 slide over the bulb 42, the clip 10 snaps or springs towards its unstressed configuration onto the tee 31 and assumes the position illustrated in FIG. 5 or 6. In this position, the clip 10 is securely retained on the tee 31 by the hook edge surfaces 27 which interfere with the bulb 42 when there is a force tending to move the clip laterally of the tee 31.

A U-molding 32 usable with the low profile clip 10 is illustrated in cross-section in FIGS. 5 and 6. The molding 32 can be a standard shape conventionally used in the suspended ceiling industry as a wall molding with a nominal width across the outside of the flanges or legs 47, 48 of, for example, 1-9/16" but the width can be 2-¼" or even larger where necessary or desired. The molding 32 is roll formed from a strip of sheet metal into an asymmetric U-shape. The distal edges of the flanges or legs 47, 48 are formed with in-turned hems 49. Installation of the molding 32 on a main tee or cross tee 31, there being a suitable number of clips 10 in place on the main tee or cross tees, is accomplished by simply aligning the molding with the clips and pushing the molding horizontally onto the clips. The clips 10 are constructed and arranged to allow the molding 32 to resiliently deform so that its flanges or legs 47, 48 pass over respective lower and upper extensions 12, 13 of the clip and snap into the illustrated installed position. The lengths of the extensions 12, 13 are arranged so that they lie within the inner hem edges 51 of the respective flange or leg 47, 48. It will be noted that a free edge 52 of the upper extension and a free edge 53 of the thumbnail form or grip 22 are unencumbered by adjacent areas of the clip 10 or tee 31 so that they can catch on the inner edges 51 of the hems 49. When the molding 32 is fully pushed onto the clip 10, the free edge 52 of the upper extension 13 and the free edge 53 of the thumbnail grip 22 lock against the hem edges 51.

The configuration of the clip 10 causes it to be vertically squeezed by the molding 32; this has the advantage that its retention on the tee 31 increases because any force tending to spread or raise the upper extension 13 to release the catch surface 27 has to overcome the resistance of the molding to deform as well as the resistance of the upper flange to deflect. A similar function occurs at the lower extension 12 where friction forces and the tab 20 function to lock this part on the tee. Where desired, screws 19 assembled through the holes 18, can be driven into the web of the tee 31 to lock the clip 10 in place.

Figure 7:
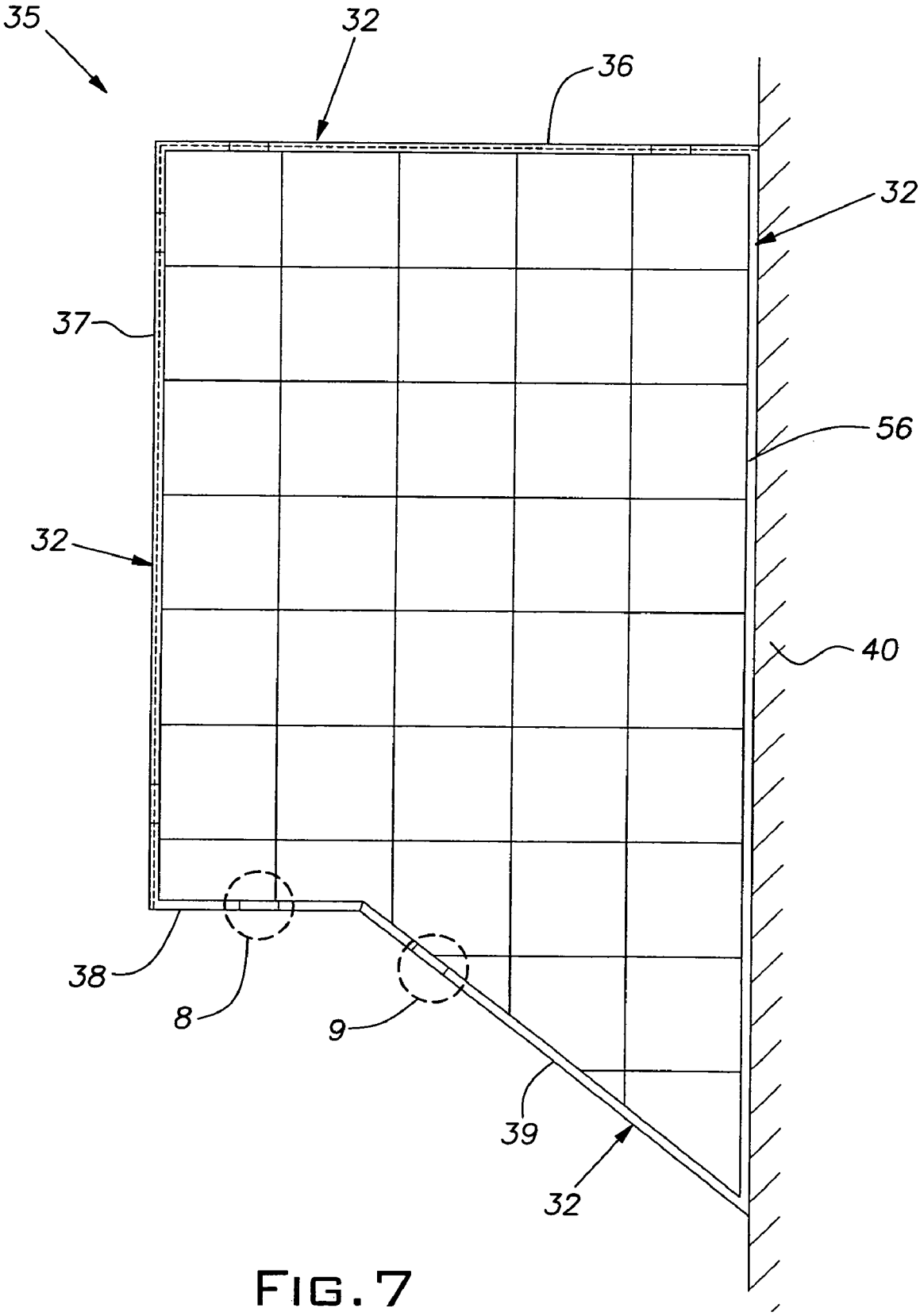
FIG. 7 is a schematic plan view of a suspended ceiling having an island portion.
Figure 8:
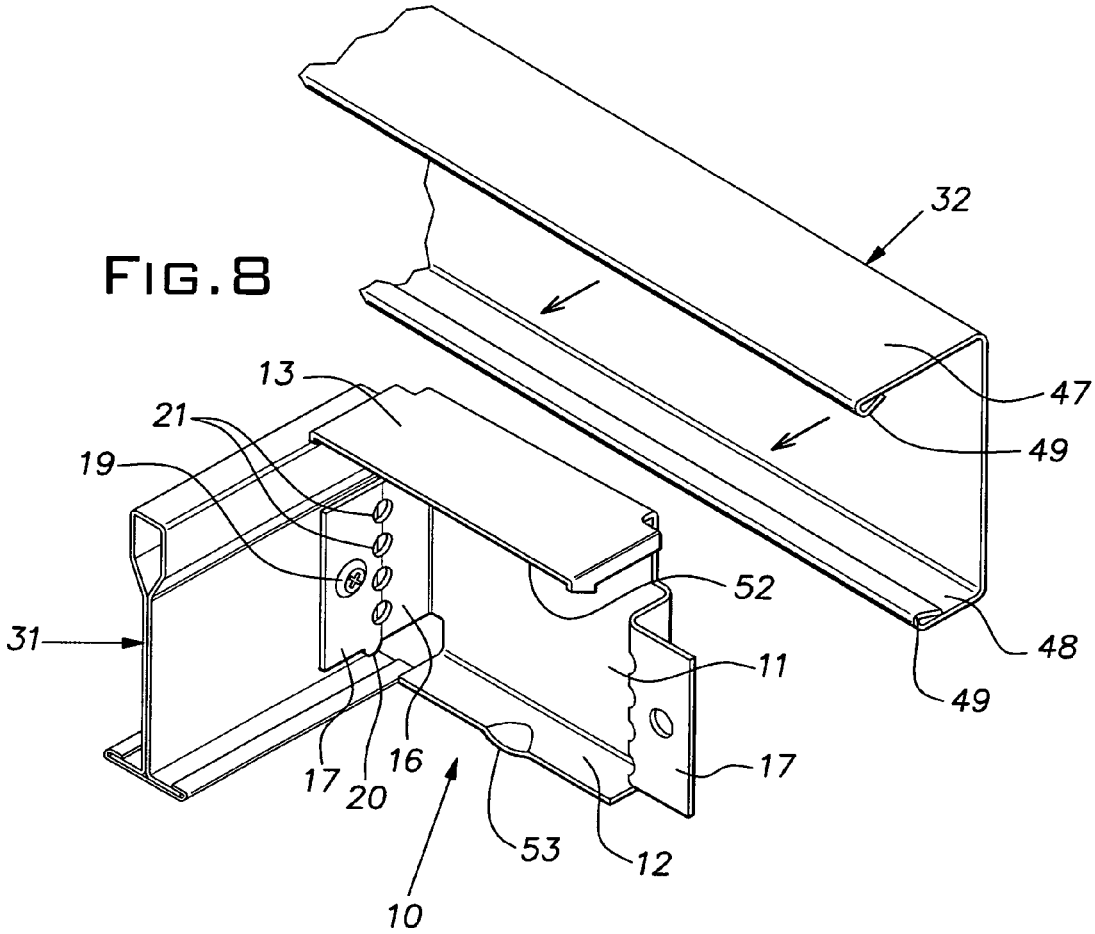
FIG. 8 is a perspective view of the clip arranged to support a molding at right angles to a grid tee.
Figure 9:
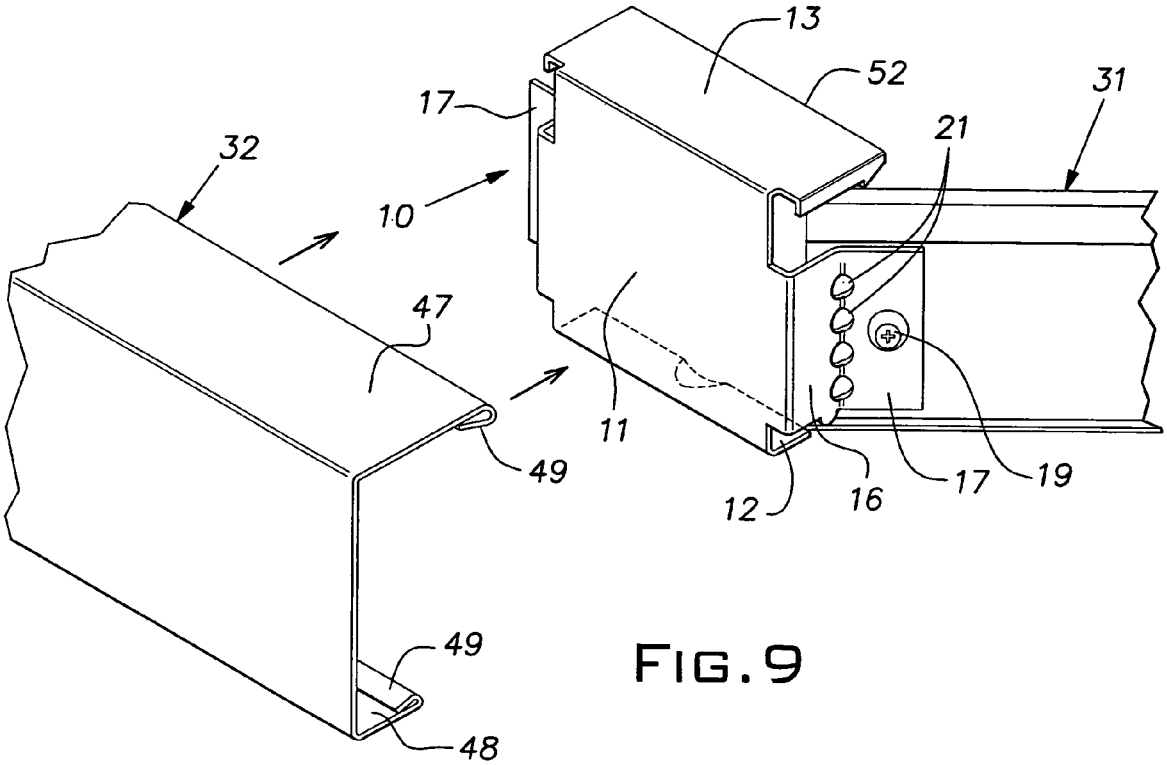
FIG. 9 is a perspective view of the clip arranged to support a molding at an angle different than 90° to a grid tee.

FIG. 7, briefly referenced above, is a diagrammatic view of a suspended ceiling that is a partial island. The ceiling is attached to a wall 40 at one side 56. FIGS. 8 and 9 illustrate conditions typical of those circled at 8 and 9, respectively, where the trim molding 32 is attached to grid tees 31 that intersect the molding at angles rather than being attached to grid tees in parallel.

As shown in FIG. 8, the clip 10 can be used to connect an edge molding 32 to a grid tee 31 at right angles. The clip 10 is modified, ordinarily in the field by the installer, by bending the clip at the corner between a foot 17 and leg 16 where the holes 18 weaken the area between these elements. The corner is bent straight so that the foot 17 is permanently aligned or coplanar with the associated leg 16.

The clip 10 is fastened to the tee 31 with a screw 19 driven through the hole 18 in the foot 17 that is bent into alignment with the leg 16. The clip is located vertically by placing the gripping tab 20 on the inner or upper side of the grid tee flange 41 as shown in FIG. 8. When the clip 10 is installed and other clips along the line to be taken by the edge molding 32 are similarly installed, the molding can be mounted on the clips by simply pushing it onto them until it is locked in place at the individual clips by the locking edges 52 and 53 of the lower and upper extensions 12 and 13 respectively.

FIG. 9 shows that the clip 10 can be modified by manually bending the corner between a foot 17 and leg 16 to an angle that aligns the center section 11 with the desired angle between the tee 31 and molding 32. As described in connection with FIG. 8, a screw 19 holds the bracket in place, once it is located by resting the tab 20 on the tee flange 41. The molding 32 is installed as described in connection with FIG. 8.

While the clip has been disclosed in the form of a sheet metal stamping, the clip may take other forms including that of an injection molded plastic part. The molding has been disclosed as a roll formed sheet metal piece having an asymmetrical U-shape, but other constructions are contemplated. For example, the molding can be extruded of aluminum or plastic with or without formations equivalent to the hems on the distal edges of the molding flanges.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A sheet metal clip for attaching U-molding to a grid tee in parallel alignment, the clip having lower and upper extensions projecting substantially perpendicular from an intermediate center section, the lower extension being adapted to fit below a flange of the grid tee, the upper extension being adapted to snap fully over an upper side of and lock onto a hollow reinforcing bulb of the grid tee when the lower extension is in contact with the flange of the grid tee and the center section is moved towards a side of the grid tee, the lower and upper extensions each having surfaces facing away from the center section, the clip being constructed to be received in a U-molding longitudinally aligned with the grid tee and having flanges spaced apart a distance substantially equal to a spacing of said extension surfaces whereby said extension surfaces are adapted to lock onto inside edges of inside hems of flanges of the U-molding when it is slipped over the clip, the clip having sides adapted to abut a web of the grid tee under the hollow reinforcing bulb.

2. A sheet metal clip as set forth in claim 1, wherein the sides each have a stand-off leg that extends in a plane perpendicular to the grid tee web and abuts the web under its reinforcing bulb when attached to a tee.

3. A sheet metal clip as set forth in claim 2, wherein said legs each have a foot adapted to abut the web of the grid tee under the hollow reinforcing bulb.

4. A sheet metal clip as set forth in claim 3, wherein a corner between a stand-off leg and the associated foot is perforated to facilitate manual bending of a corner area to align the center section and extensions with a line of a molding when the molding intersects a line of the grid tee at an angle different than 90°.

5. A sheet metal clip as set forth in claim 1, wherein the sides of the clip include a tab registerable on a top of a flange to vertically align the clip to a grid tee.

* * * * *